United States Patent [19]

Stephens et al.

[11] 4,269,403

[45] May 26, 1981

[54] WORKSHEET PRESENTING APPARATUS

[75] Inventors: Frederick N. Stephens; Joseph L. Stephens, both of Paola, Kans.

[73] Assignee: Stephens Systems, Inc., Lenexa, Kans.

[21] Appl. No.: 957,996

[22] Filed: Nov. 6, 1978

[51] Int. Cl.[3] ..... B65H 3/52

[52] U.S. Cl. ..... 271/3; 271/114; 271/121; 271/273; 400/718

[58] Field of Search ..... 271/3, 4, 114, 121, 271/122, 124, 125, 273, 34; 400/718, 718.1, 718.2

[56] References Cited

U.S. PATENT DOCUMENTS

| | | | |
|---|---|---|---|
| 113,291 | 4/1871 | Graves | 271/119 |
| 650,410 | 5/1900 | Morin | 271/121 |
| 727,369 | 5/1903 | Houle | 400/718.1 |
| 3,154,356 | 10/1964 | Lewis et al. | 271/207 |
| 3,658,319 | 4/1972 | Glaser | 271/14 X |

FOREIGN PATENT DOCUMENTS

| | | | |
|---|---|---|---|
| 2719182 | 11/1978 | Fed. Rep. of Germany | 271/34 |
| 6512459 | 3/1966 | Netherlands | 271/4 |

*Primary Examiner*—Robert W. Saifer
*Attorney, Agent, or Firm*—Shenier & O'Connor

[57] ABSTRACT

Apparatus for successively presenting sheets for inspection by a keyboard operator or the like who must with a both hands otherwise occupied. A support inclined upwardly from a discharge end spaced above the work table holds a stack of sheets to be fed. A feed roller disposed across the discharge end in engagement with the upper side of the stack is energized to advance sheets successively therefrom, while a plurality of frictional retarding elements disposed across the discharge end in engagement with the lower side of the stack prevent the feeding of more than one sheet at a time. The retarding elements are urged against the stack with greater biasing force near the center of the discharge end than at the edges thereof to provide an automatic centering action.

5 Claims, 6 Drawing Figures

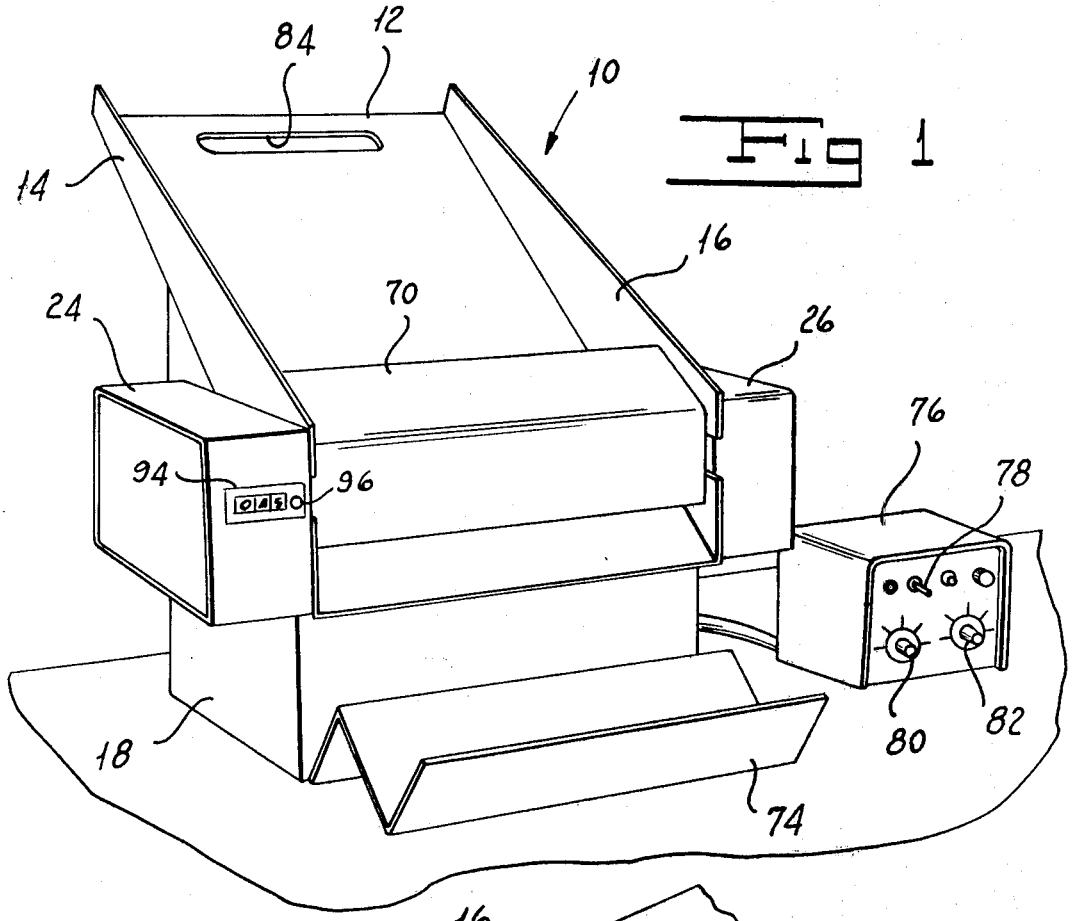
Fig 1
Fig 5
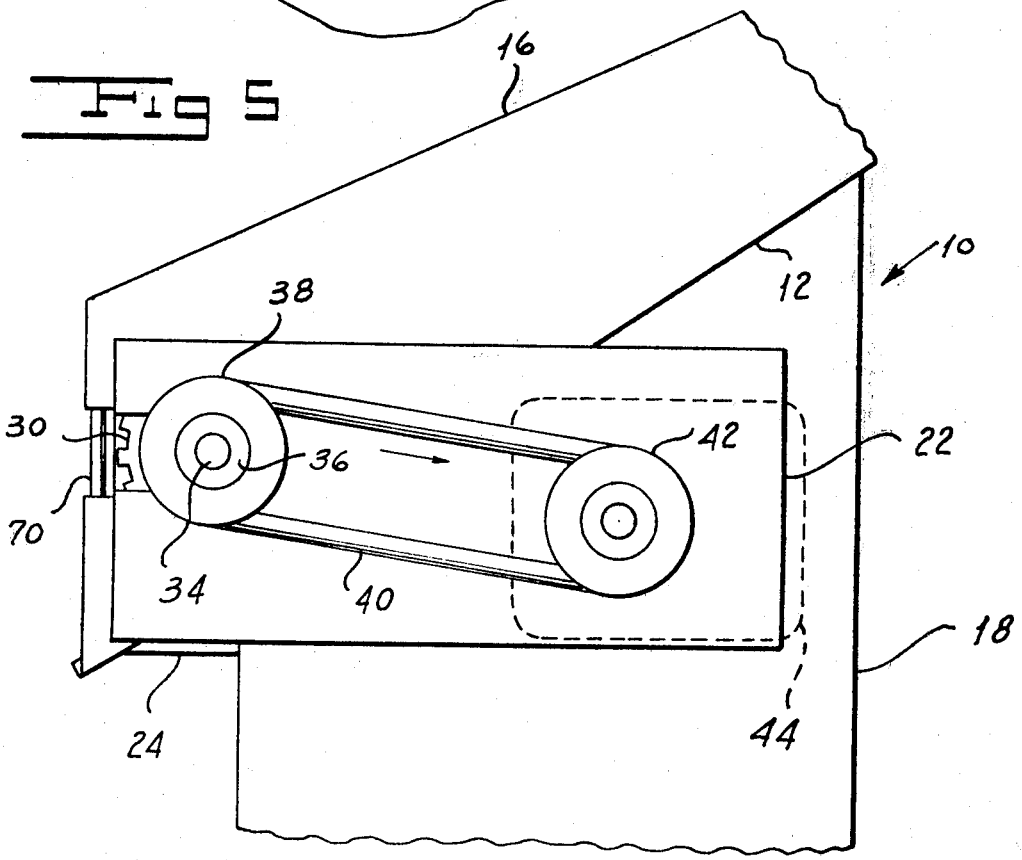

WORKSHEET PRESENTING APPARATUS

BACKGROUND OF THE INVENTION

Routine processing of paper forms, such as bill payment stubs, change-of-address forms and the like, while a necessary part of many business operations, is beset with the problem of worker productivity. The repetitive changeover between fetching the next form to ascertain the updating information, such as amount paid, new address, and the like, and transferring this information to a central file through a keyboard or the like results in relatively low productivity, since the operator is never engaging in any one activity long enough to work at maximum efficiency. The inherently monotonous nature of the work, moreover, has a further deleterious effect on productivity, causing output to slacken after a relatively short time.

SUMMARY OF THE INVENTION

One of the objects of our invention is to provide an apparatus which facilitates the processing of paper forms.

A further object of our invention is to provide a worksheet presenting apparatus which may be set to regulate the speed at which the operator processes paperwork.

Another object of our invention is to provide an apparatus which allows the operator to be continuously engaged in a single activity.

Still another object of our invention is to provide an apparatus which increases worker interest and motivation.

A further object of our invention is to provide an apparatus which accepts sheets of various sizes and thicknesses without readjustment.

Other and further objects of our invention will be apparent from the following description.

In general, our invention contemplates a worksheet presenting apparatus comprising a hopper having a discharge end from which sheets of a stack in the hopper are successively fed. A base adapted to be set on a work surface such as a table supports the hopper with the discharge end spaced above the work surface. A preferably variable-speed feed roller or the like is driven to advance sheets from the stack successively off the discharge end of the hopper to the work surface where they can be read and the appropriate action taken by the operator. The above-described apparatus leaves the operator's hands continuously free for the necessary data entry activity, such as operation of a keyboard, resulting in a higher efficiency since the operator's hands are always in place on the keyboard and acclimated to a single activity. Moreover, the pacing provided by the apparatus increases worker interest by continuously presenting the worker with a goal, resulting in further gains in productivity.

In a preferred form of our invention, a feed roller is disposed across the discharge end in engagement with the upper surface of the stack while a plurality of frictional retarding elements spaced across the discharge end are biased into engagement with the lower surface of the stack beneath the feed roller to inhibit multiple feeding. This arrangement permits the individual control of feed pressure at various points across the discharge end with a precision not readily attainable using such alternate expedients as a unitary retarding member of fixedly positioned multiple retarding members. As a result, the apparatus readily handles sheet materials of various sizes and thicknesses without readjustment. Preferably, the retarding elements are urged against the stack with a greater biasing force near the center of the discharge end than at the edges thereof to provide an automatic centering action.

BRIEF DESCRIPTION OF THE DRAWINGS

In the accompanying drawings to which reference is made in the instant specification and in which like reference characters are used to indicate like parts in the various views:

FIG. 1 is a perspective view of a preferred embodiment of our worksheet presenting apparatus.

FIG. 5 is a fragmentary right side elevation of the apparatus shown in FIG. 1, with the right side cover removed.

DETAILED DESCRIPTION OF THE PREFERRED EMBODIMENT

Figure 2:
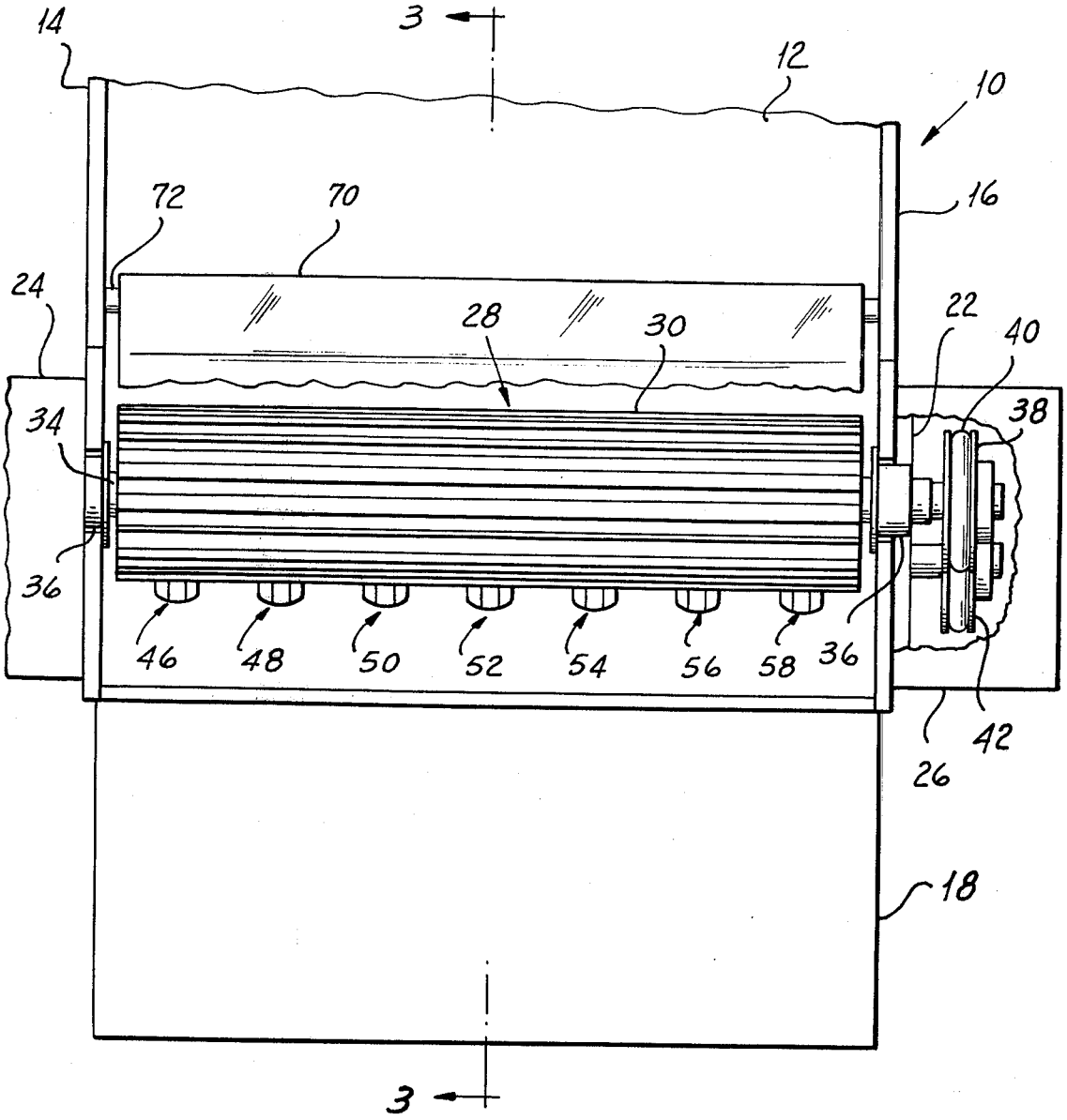
FIG. 2 is an enlarged fragmentary front elevation of the apparatus shown in FIG. 1, with parts broken away.

Referring now to the drawings, our worksheet presenting apparatus, indicated generally by the reference numeral 10, includes a support 12 for receiving a stack S of documents to be fed. If desired, the support 12 may be formed with a finger insert 84 near the upper end thereof to provide a convenient handle for carrying or rearranging the apparatus 10. Support 12 includes respective left and right side walls 14 and 16 and rests on a base 18 in a position upwardly inclined from the delivery end of the support.

A feed roller indicated generally by the reference numeral 28 comprises an axially grooved outer layer 30 formed around a cylindrical core 32 concentric with a shaft 34. In one specific embodiment of the apparatus 10, feed roller 28 has a diameter of $2\frac{1}{2}$ inches and is formed with sixteen equally spaced grooves each $\frac{1}{4}$ inch wide and $\frac{1}{8}$ inch deep. Outer layer 30 preferably comprises rubber having a durometer hardness of between 15 and 20. A pair of bearings 36 received in respective left and right side plates 20 and 22, mounted outboard of the respective support side walls 14 and 16 and normally housed by respective left and right side covers 24 and 26, rotatably receive the roller shaft 34. In the specific embodiment discussed hereinabove preferably a clearance of about 1/16 inch is provided between the outer layer 30 of the roller 28 and the support 12. An end of roller shaft 34 which extends beyond the right side plate 22 carries a pulley 38 for rotation therewith. A belt 40 couples pulley 38 to a second pulley 42 received by the shaft of a reversible motor 44 disposed between the side walls of the base 18.

Roller 28 is driven by motor 44 in such a direction as to separate the uppermost document from the stack and advance it downwardly off the feed end of the support 12. A plurality of retarding elements indicated generally by reference characters 46, 48, 50, 52, 54, 56, 58 spaced across the support 12 at preferably $1\frac{1}{2}$ inch intervals exert an upward force on the bottom of stack S at spaced locations thereacross so as to retard the passage of all except the uppermost document. Each of the retarding elements comprises a foot 66 of frictional material having a coefficient of friction to paper greater than that of the paper to paper but less than that of the material of grooved outer layer 30 of the roller 28 to paper. Each foot 66 is carried at one end of a lever 60 which pivots around a common shaft 62 and which carries a weight 64 at the other end thereof. Retarding elements 46 through 58 are so disposed that the feet extend through openings 68 in the support 12 opposite the feed roller 28.

Figure 3:
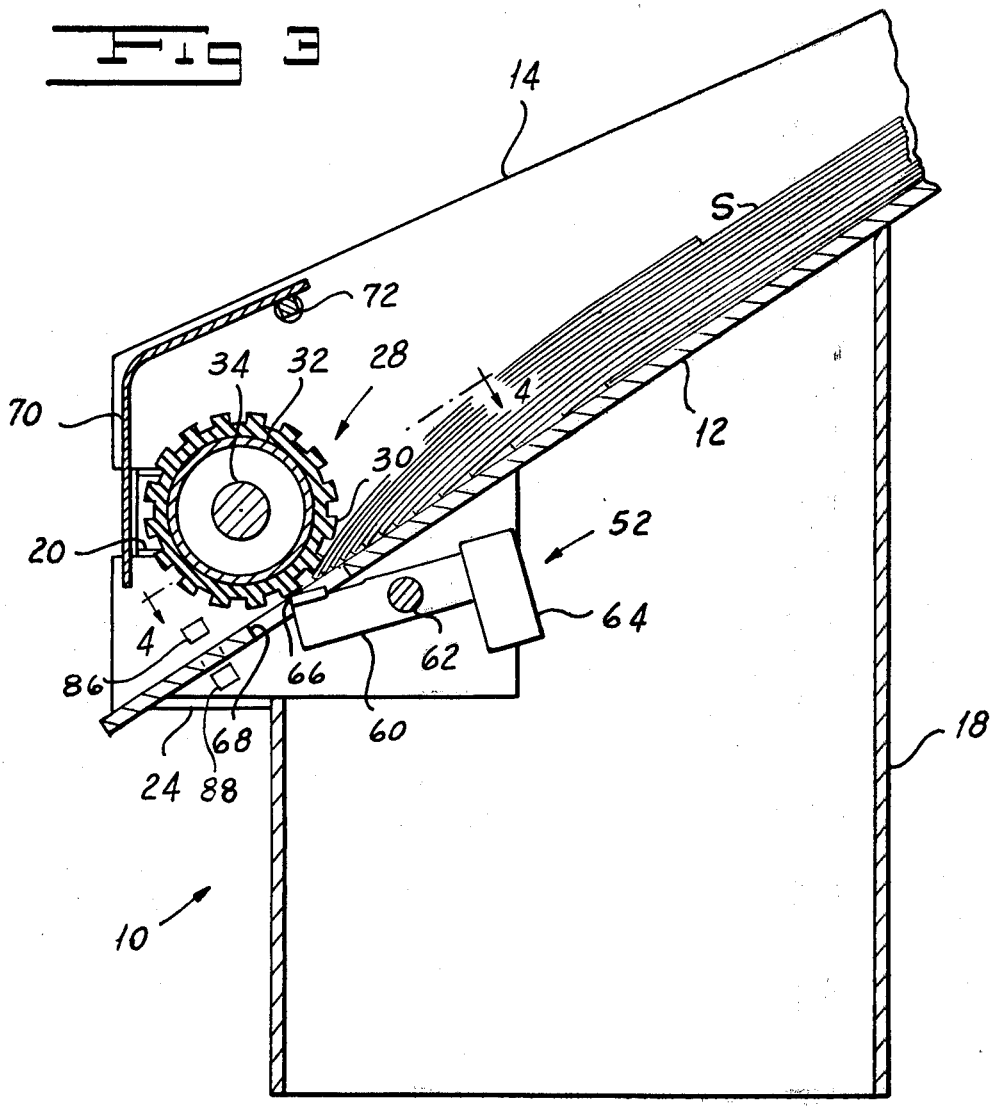
FIG. 3 is a section of the apparatus shown in FIG. 1, taken along line 3—3 of FIG. 2.
Figure 6:
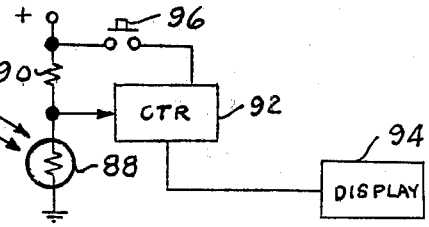
FIG. 6 is a schematic diagram of a counter circuit which may be used with the apparatus shown in FIG. 1.
Figure 4:
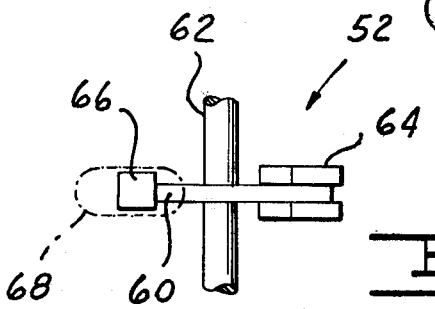
FIG. 4 is a fragmentary view of our worksheet presenting apparatus, taken along line 4—4 of FIG. 3, with parts removed to illustrate one of the retarding elements of the apparatus.

In normal operation, motor 44 drives feed roller 28 in a clockwise direction as viewed in FIG. 3 to advance the uppermost sheet of the stack S through the nips formed by the roller 28 with the retarding feet 66 and off the discharge end of the support 12 into a suitable receiving tray 74. Tray 74, which may be provided in a plurality of sizes corresponding to various sizes of sheet such as punched cards, stubs and the like, serves as a collecting receptacle while at the same time tilting the fed sheet toward the operator to facilitate reading updating information contained thereon. Roller 28 also imparts a jogging action to elements 46 through 58 which greatly improves the unit's performance.

As we have noted above, the use of a plurality of transversely spaced retarding elements 46 through 58 individually biased into engagement with the feed roller 28 permits the ready handling of sheet materials of various sizes and thicknesses without requiring adjustment of parts. Thus, the apparatus 10 shown handles sheets ranging in thickness from onionskin to $\frac{1}{8}$-inch-thick envelopes, as well as sheets ranging in width between 2 inches and 11 inches, the full width of the support 12. Narrower sheets may be accommodated by spacing the retarding elements 46 through 58 more closely to one another, while thicker documents may be provided for by increasing the clearance between feed roller 28 and support 12.

Preferably, to correct any skew which may arise in the document being fed and to provide an automatic centering action, the weights 64 of the retarding elements 46 through 58 are made heavier near the center line between side walls 14 and 16 than at the left or right sides of the support 12 to provide a greater biasing force in the center region. Thus if, for example, a document being advanced is to the right of center, the center retarding elements will exert a relatively high retarding force while the rightmost retarding elements will exert a lower retarding force against the sheet being fed. As a result, the document will tend to slip relative to feed roller 28 more along the center than at the right side of the support 12 and will thus tend to move toward the center, correcting the original misalignment.

A protective cover 70 preferably of a transparent plastic material normally shields the feed roller 28 from the fingers of the operator but swings upwardly around a pivot shaft 72 received by side walls 14 and 16 to expose the roller 28. Our apparatus 10 also includes a separate control box 76 the front panel of which carries an on-off switch 78 for turning the apparatus on and off, a continuously variable speed control knob 80 for adjusting the speed of the motor 44, and a three-way forward-brake-reverse control switch 82 for controlling the direction of rotation of the motor 44.

Movement of the switch to the "brake" position temporarily disables the motor 44, while movement to the "reverse" position causes feed roller 28 to rotate counterclockwise, as viewed in FIG. 3, to return a partially fed sheet to the stack 8. In the apparatus 10 shown, the speed of sheet advance may be varied between 50 and 1100 inches per minute.

If desired, the apparatus may also include a counter for indicating the number of sheets that have been fed. In such a case, a light source 86 is arranged downstream of the feed roller 28 on one side of the path followed by the sheets being fed. Light source 86 provides a light beam which normally impinges on a photoconductive cell 88 disposed on the other side of the feed path opposite the source 86, but which is interrupted by a sheet being fed.

Cell 88 is coupled at one terminal to ground to form the lower branch of a voltage divider circuit, the upper branch of which is formed by a resistor 90 coupled to a positive voltage source (not shown). A digital counter 92, the clock pulse input of which is connected to the junction of cell 88 and resistor 90, drives a digital display 94 mounted on one of the side covers 24 and 26 or other convenient location. The counter may be reset by depressing a normally open pushbutton switch 96 associated with the digital display 94 and coupled between the positive voltage source and the reset (R) input of counter 94.

Normally, with no sheet between light source 86 and cell 88, cell 88 remains relatively conductive and its ungrounded terminal remains at a relatively low potential. When a sheet interrupts the light path, cell 88 becomes relatively nonconductive and its ungrounded terminal shifts to a relatively high potential. The positive-going level change in turn clocks counter 92, which provides the updated count to display 94.

It has been seen that we have accomplished the objects of our invention. Our worksheet presenting apparatus facilitates the processing of paper forms by feeding sheets automatically to allow the operator to be continuously engaged in a single activity and by providing a pacing action to increase worker interest and motivation. Moreover, our apparatus accepts sheets of various sizes and thicknesses without readjustment.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Sheet feeding apparatus including in combination a friction roller, a plurality of frictional retarding elements, means for biasing said retarding elements for individual movement in the direction of said friction roller at axially spaced locations across said roller at various distances from a predetermined point along the length of said roller, said biasing means applying a progressively greater biasing force to retarding elements disposed nearer said predetermined point, means for supporting a stack of sheets to be fed with a sheet thereof adjacent said roller and said retarding elements, and means for driving said roller in such a direction as to separate said sheet from said stack and advance it between said roller and said retarding elements.

2. Sheet feeding apparatus including in combination a friction roller, a plurality of frictional retarding elements, means for biasing said retarding elements for individual movement in the direction of said friction roller at axially spaced locations across said roller at various distances from a predetermined point along the length of said roller, said biasing means comprising respective lever arms carrying said retarding elements and respective weights carried by said lever arms, said weights applying a progressively greater biasing force to the retarding elements disposed near said predetermined point, means for supporting a stack of sheets to be fed with a sheet thereof adjacent said roller and said retarding elements, and means for driving said roller in such a direction as to separate said sheet from said stack and advance it between said roller and said retarding elements.

3. Sheet feeding apparatus including in combination a friction roller having axial grooves on the surface thereof, a plurality of frictional retarding elements, means for biasing said retarding elements for individual movement in the direction of said friction roller at axially spaced locations across said roller at various distances from a predetermined point along the length of said roller, said biasing means applying a progressively greater biasing force to retarding elements disposed nearer said predetermined point, means for supporting a stack of sheets to be fed with a sheet thereof adjacent said roller and said retarding elements, and means for driving said roller in such a direction as to separate said sheet from said stack and advance it between said roller and said retarding elements.

4. Worksheet presenting apparatus including in combination a hopper for accepting a stack of sheets containing graphic matter thereon, said hopper having a discharge end, a base adapted to be set on a surface, said base supporting said hopper with the end thereof spaced above said surface, a collecting tray arranged to receive sheets from said hopper, said tray supporting said sheets in such a manner as to display said graphic matter to a viewer, means for successively advancing sheets from said stack off said discharge end to said collecting tray, means for adjusting the rate of advance of said advancing means, and means for counting the number of sheets advanced from said stack off said discharge end, said advancing means comprising a friction roller, a plurality of frictional retarding elements, means for biasing said retarding elements for individual movement in the direction of said friction roller at axially spaced locations across said roller at various distances from a predetermined point along the length of said roller, said biasing means applying a progressively greater biasing force to retarding elements disposed nearer said predetermined point, said hopper supporting said stack of sheets with a sheet thereof adjacent said roller and said retarding elements, and means for driving said roller in such a direction as to separate said sheet from said stack and advance it between said roller and said retarding elements.

5. Sheet feeding apparatus including in combination a friction roller, a plurality of frictional retarding elements, means for biasing said retarding elements for individual movement in the direction of said friction roller at axially spaced locations across said roller, said biasing means comprising respective lever arms carrying said retarding elements and respective weights carried by said lever arms, means for supporting a stack of sheets to be fed with a sheet thereof adjacent said roller and said retarding elements, and means for driving said roller in such a direction as to separate said sheet from said stack and advance it between said roller and said retarding elements.

* * * * *